US005251400A

United States Patent [19]

Schultze

[11] Patent Number: 5,251,400

[45] Date of Patent: Oct. 12, 1993

[54] CONTROL FOR A DOOR CLOSER HAVING A POWER-ASSIST OPENING FEATURE

[75] Inventor: Eckart F. Schultze, Charlotte, N.C. 28210

[73] Assignee: Yale Security Inc., Monroe, N.C.

[21] Appl. No.: 905,420

[22] Filed: Jun. 29, 1992

[51] Int. Cl.[5] ..... E05F 15/10

[52] U.S. Cl. ..... 49/32; 49/340; 16/58

[58] Field of Search ..... 49/32, 334, 340; 16/58; 74/436

[56] References Cited

U.S. PATENT DOCUMENTS

| | | | |
|---|---|---|---|
| 2,409,300 | 10/1946 | Miles | 74/436 |
| 3,470,653 | 10/1969 | Kalog | 49/32 |
| 3,497,997 | 3/1970 | Sheckells | 49/32 |
| 3,831,458 | 8/1974 | Takanashi et al. | 74/439 |
| 3,874,117 | 4/1975 | Boehm | 49/340 X |
| 3,936,977 | 2/1976 | Runft et al. | 49/340 X |
| 3,948,000 | 9/1976 | Pedersen | 49/340 |
| 4,429,490 | 2/1984 | Zunkel | 49/32 |
| 4,501,090 | 2/1985 | Yoshida et al. | 49/334 X |
| 4,995,194 | 2/1991 | Schultze et al. | 49/32 |
| 5,165,295 | 11/1992 | Dohnal et al. | 74/436 |

*Primary Examiner*—Peter M. Cuomo
*Assistant Examiner*—Michael J. Milano
*Attorney, Agent, or Firm*—Dallett Hoopes

[57] ABSTRACT

A control for a power-assist feature for an hydraulic closer is driven by structure mounted on the pinion shaft of the closer. It includes a pump-activating arm slidably mounted on the shaft, the end of the arm adapted to cover a pump-on sensor when the door is 'bumped'. It also includes a follower rotatably mounted near the pinion and engageable escapement-fashion by a wheel in friction fit on the pinion shaft, the follower carrying a pump-deactivating arm, the end of the latter arm adapted to move away from a pump-off sensor when the door opens to its preset limit.

9 Claims, 3 Drawing Sheets

CONTROL FOR A DOOR CLOSER HAVING A POWER-ASSIST OPENING FEATURE

BACKGROUND OF THE INVENTION

1. Field of the Invention

This invention relates to a control for a door closer having a power-assist opening feature, the control being driven by the pinion shaft of the closer. More specifically, the control comprises parts which move to affect sensors preferably of the photoelectric type, to start and stop the power-assist feature.

2. Description of Related Art including Information Disclosed under §§1.97 to 1.99

This invention relates to an improvement on the door control disclosed in U.S. Pat. No. 4,995,194 assigned to my assignee. In that control mechanical switches are driven by appendages mounted on the pinion shaft of the closer.

While there are a number of patents related to door openers and power-assist door closers, the most pertinent is the '194 patent mentioned above.

Also, the Zunkel U.S. Pat. No. 4,429,490 issued Feb. 7, 1984 discloses a control arm mounted on the door closer shaft so that when the opening of the door is commenced manually, the arm engages a switch to activate the opener.

SUMMARY OF THE INVENTION

The invention is a door control for a closer having a power-assist feature to assist partially or completely in the opening of the door, the closer being of the hydraulic type including a cylinder enclosing a piston with an associated rack. The rack meshes with the pinion having a shaft which extends outside the cylinder and attaches to an arm operator for the door. An electric pump connected in a control circuit pumps the hydraulic fluid against the piston to open the door. The control, which is activated by the pinion shaft, turns the pump off and on.

The invention includes a drive wheel frictionally mounted on the pinion shaft. Pump-activating means comprises an arm frictionally related to the wheel and a fixed pump-on sensor in the control circuit mounted adjacent the end of the arm and adapted to turn on the pump when the arm arrives at a position closely proximate the sensor.

The invention also involves pump-deactivating means comprising a rotary follower mounted on the closer adjacent the wheel, a second arm extending outward from the follower, a fixed pump-off sensor also in the control circuit mounted adjacent the end of the second arm and adapted to turn off the pump when the second arm leaves a position closely proximate the pump-off sensor, and interfitting motion-transmitting means on the periphery of the wheel and the follower such that when the wheel nears a position corresponding to the desired openness of the door the motion-transmitting means causes the follower to rotate to swing the second arm away from the sensor to turn off the pump.

BRIEF DESCRIPTION OF THE DRAWINGS

Other features and objects of the invention will be apparent to those skilled in the art from the following disclosure, including the drawings, all of which disclose a non-limiting embodiment of the invention. In the drawings.

DESCRIPTION OF THE PREFERRED EMBODIMENT

Figure 1:
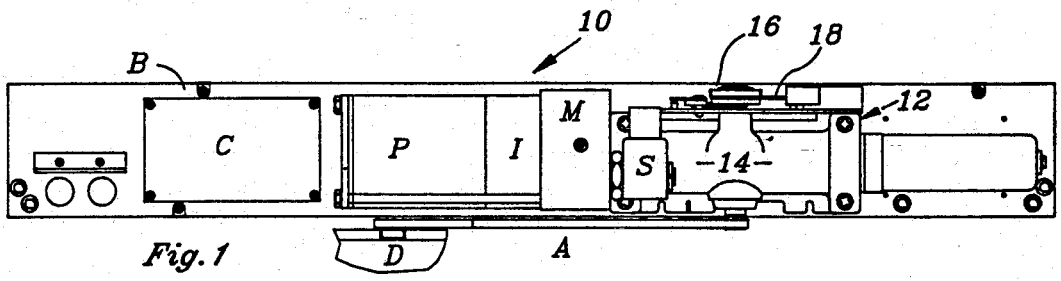
FIG. 1 is a side elevational view of an entire power-assist door closer assembly.

A door closer/power-assist opener embodying the invention is shown in FIG. 1 generally designated 10 and is installed on a door frame (not shown) above the door D. It comprises a base plate B on which are mounted a control circuit component C and an electric pump P. The pump is connected through a manifold M to the closer 12.

As well illustrated in the above-described U.S. Pat. No. 4,995,194, the closer comprises a cylinder 14 containing a piston shown). The piston P is equipped with a rack, as is conventional, which meshes with a pinion, the pinion shaft 16 emerges from both the top and bottom of the cylinder 14. At its lower end the shaft 16 (FIG. 1) is provided with an arm A the distal end of which is formed with a roller or shoe which rides on a track in the door D as shown. (The door may be imagined as hinged on the right of FIG. 1 and it opens toward the viewer.)

The upper end of the pinion shaft 16 is fitted with structure which comprises the pump-activating and deactivating controls generally designated 18.

In operation, when the door D is pushed slightly open, or "bumped", the controls 18 will turn on the pump P and through the manifold M the pump will force fluid against the piston, moving the piston and its rack and pinion driving the shaft 16 in a counter-clockwise direction. This will open the door, or at least assist in its opening, depending on the setting of valves as described fully in U.S. Pat. No. 4,995,194, until the door reaches the degree of openness to which the control has been set, at which point the control 18 will turn off the pump and permit the spring (not shown) in cylinder 14 to power the piston back to its home position whereat the door is closed.

Figure 2:
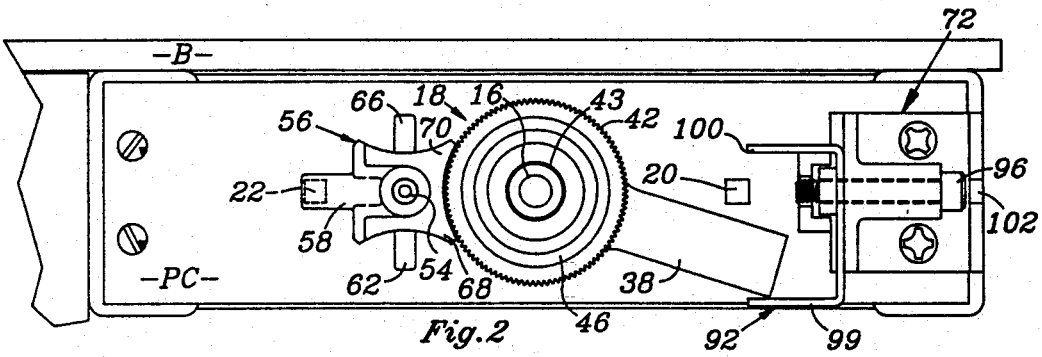
FIG. 2 is a top plan view of the door control mounted on the closer and showing in dotted lines alternate positions of the bump distance setting.

With this background, details of the control 18 will now be described. On the top of the cylinder 14 is mounted a printed circuit board PC (FIG. 2). The circuitry is omitted from the drawings for the sake of simplicity. The board PC is apertured to pass the shaft 16 and the board carries a pump-on sensor 20 and a pump-off sensor 22, schematically indicated as squares in the figures. These units preferably each combine an emitter and sensor packaged into one unit.

Figure 3:
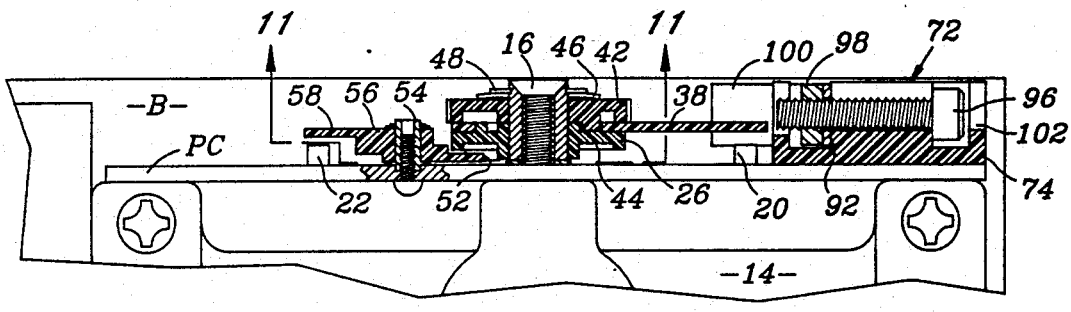
FIG. 3 is a fragmentary side elevational view of the door closer showing the elements of the control in section, the activating arm being shown in centerline position.
Figure 4:
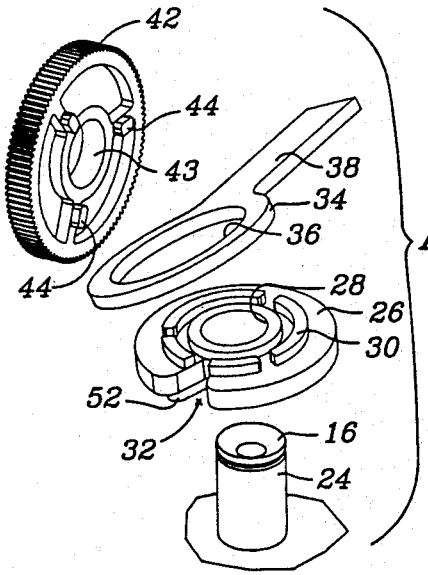
FIG. 4 is a fragmentary perspective exploded view of a portion of the door control.

The pinion shaft 16 (FIG. 3) is provided with a collar 24 having a smooth outer surface and keyed to turn with the shaft 16. A plastic drive wheel 26 has a central hub and opening 28 which fits about the collar 24 down to a shoulder as shown and is of such a dimension that the wheel 26 may be turned relative to the collar 24 if appropriate force is used to turn the parts relatively. The wheel 26 as shown in FIG. 4 is formed with an interrupted annular upward rib 30 and a generally V-shaped notch 32.

A ring 34, which may be of plastic also, has a central opening 36 which is sized to fit about the interrupted rib 30 of wheel 26. From the ring extends the pump-activating arm 38.

A peripherally ribbed dial 42 is provided formed with a hub and central opening 43 which is ample to receive loosely the collar 24. Axially extending nibs 44 are uniformly spaced about the hub and in assembly the nibs 44 fit down into the interruptions in the annular rib 30 on the wheel as shown in FIG. 3. The rib 30 and nibs 44 are disposed snugly inside the opening 36 of the ring 34 in the stacked assembly thus far described.

A spring 46 (FIG. 3) rides on the top of the stacked assembly and a retaining ring 48 fits into a peripheral groove in the collar 24 to retain the assembly in stacked condition. The spring 46 serves to press the margins of the dial 38 against the ring 34 (FIG. 3). The pressure is such that rotation of the assembly as the pinion shaft turns causes a swing movement of the arm 38 until the end of the arm meets an obstruction after which the ring slips and stops turning while the dial 42 and wheel 26, keyed together, keep turning.

The underside of the wheel 26 is formed with a V-shaped notch 32 in its periphery as stated and depending cam lobes 52 are integrally formed on either side of the notch for reasons which will appear.

Figure 12:
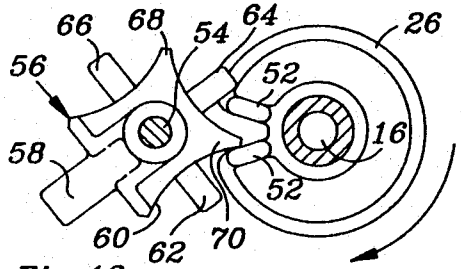
FIG. 12 is comparable to FIG. 11 but showing the parts in position comparable to FIG. 9.
Figure 13:
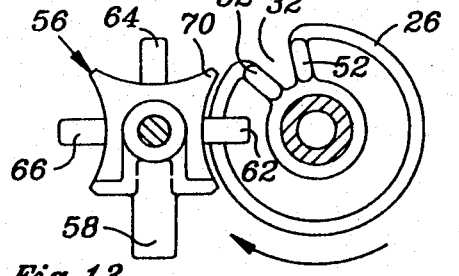
FIG. 13 is comparable to FIGS. 11 and 12 but showing the parts in position comparable to FIG. 10.
Figure 14:
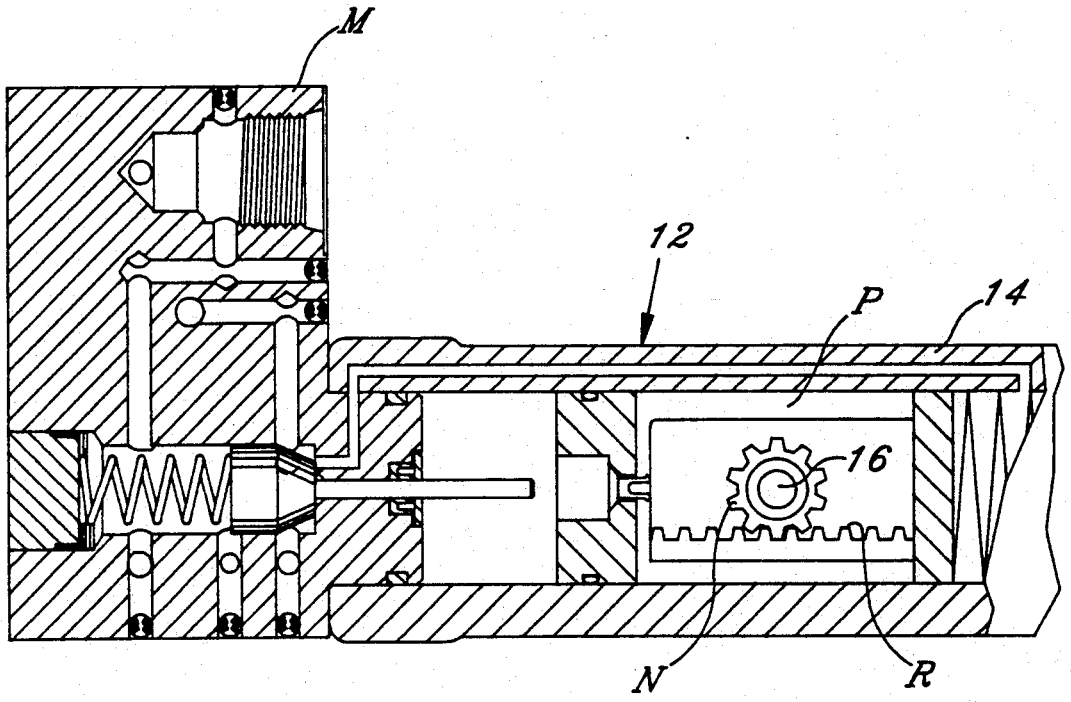
FIG. 14 is a sectional view from U.S. Pat. No. 4,995,194 showing the relationship between the closer and its parts.

Disposed on the circuit board PC spaced from the pinion shaft is the upward spindle 54 (FIG. 3). Onto the spindle is mounted rotatably the follower 56. The follower is formed with a pump deactivating arm 58 and includes a body formed of generally square shape (FIG. 1) with each side (except the one bearing arm 58) of the square being concave as at 60. Wings 62, 64 and 66 extend outward radially in the middle of each of these sides. Corners 68 and 70 define pointed ends of the follower opposite the deactivator arm 58. As will be noted from the section views looking upward FIGS. 11, 12 and 13 the wheel 26 having the notch 32 and lobes 52 cooperate with the follower 56 so that the constant rotation of the wheel 26 in one revolution will represent only a 90° turn of the follower 56 in a kind of Geneva mechanism.

Figure 6:
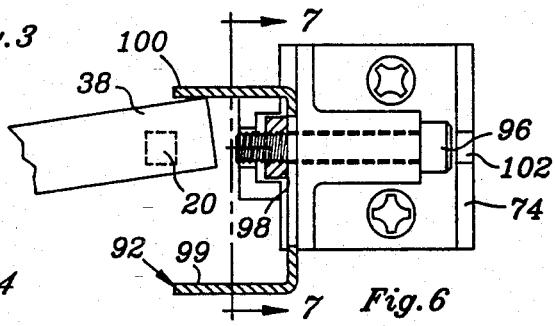
FIG. 6 is a plan view of the activating arm stop assembly showing the cover removed and showing the activating arm in fragmentary fashion.
Figure 5:
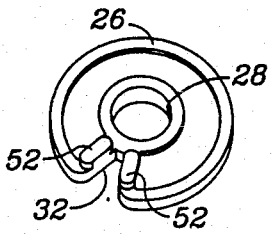
FIG. 5 is a perspective view of the underside of the wheel.

For reasons which will be explained, an assembly 72 (FIGS. 2, 3) is provided to form abutments for the travel of the activating arm 38. The assembly 72 comprises a body 74 (FIG. 6) and a U-shaped bracket 92. Bolts as shown secure the body 74 to the PC board.

The U-shaped bracket 92 has a bight which is provided with a slot 94. The slot receives a bolt 96 extending through a bore in the body 74 and a nut 98 is disposed on the bolt clamping the U-shaped bracket 92 in selected position on the body. The nut can thus be threaded on the bolt 96 and tightened or loosened by an Allen wrench in opening 102 to fix the position of the U-shaped bracket 92 with respect to the body 74. In use, as will be seen, the U-shaped bracket 92 is placed so that one of its legs 99 or 100 is in the path of the activating arm 38 and stops the swinging of the arm 38 at a point in which the arm overlies the pump-on sensor 20.

The structure of the control having been described, focus is now drawn to the operation. It will be understood that a swinging movement of the door as the door moves out of its frame as it is "bumped" and opening, results through arm A in a rotation of the pinion shaft 16. In the opening of the door such rotation of the pinion shaft also moves the piston (not shown) within the cylinder against the force of the closer cocking spring (also not shown) as is conventional.

As the door opens, the activating arm 38 swings counter-clockwise from a position where the arm 38 rests against the leg 98 (FIG. 6) to a position to which it hits the leg 100 whereat the arm overlies the sensor 20 turning on the pump P to activate the power-assist opener and close the solenoid S as described in U.S. Pat. No. 4,995,194.

As the door continues its opening movement, the pinion shaft 16 will continue on counterclockwise rotation (FIGS. 2, 9, 10), the ring 36 and the arm holding stationary and sliding with respect to the surfaces of the dial 38 and wheel 26 between which it is sandwiched.

Figure 9:
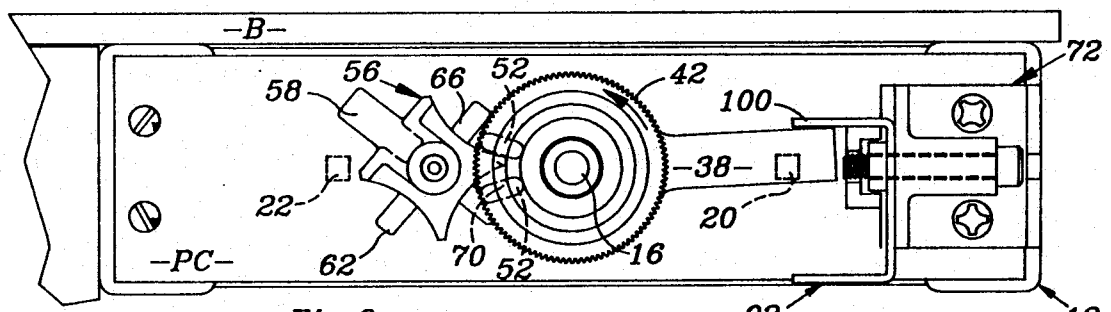
FIG. 9 shows the control with the door arriving at its open setting.
Figure 10:
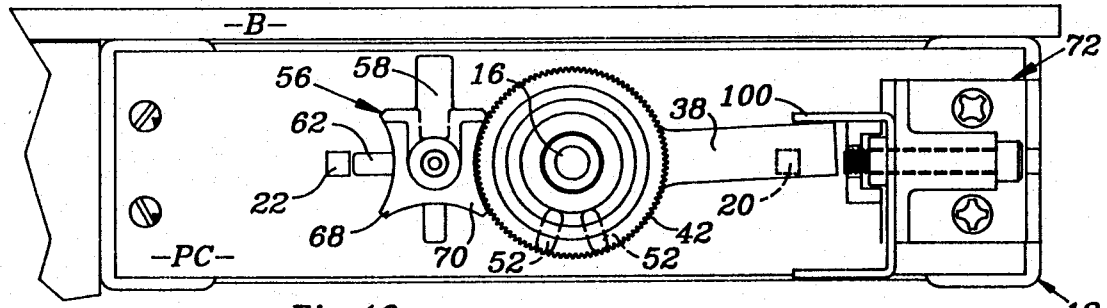
FIG. 10 shows the control when the door is pushed manually past its open setting.

The door continues to open and finally the cam lobes 52 move to nudge the wing 64 (FIG. 10) so that the notch 32 or space between lobes 52 receive the point 70 of the follower 56 and causes the follower to rotate (FIGS. 9, 10). This draws the activating arm 58 away from the close proximity of the sensor 22 and turns off the pump motor P deactivating the power-assist.

Figure 8:
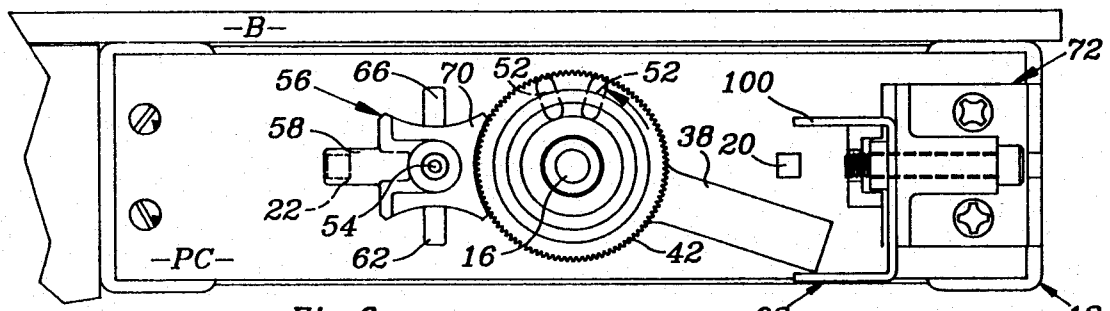
FIG. 8 is a view similar to FIG. 2 but showing the pump-activating arm in rest position as when the door is in its frame. The cam lobes on the drive wheel are shown in phantom.
Figure 11:
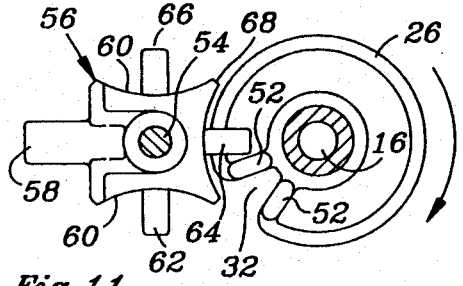
FIG. 11 is a sectional view taken on the line 11—11 of FIG. 3 and showing parts in the position illustrated in FIG. 8.

With the power-assist thus deactivated, the spring within the closer 12 (not shown) will power the piston back toward home position rotating the pinion shaft 16 in a clockwise direction and returning the follower to the position shown in FIGS. 2, 8 and 11. Alternatively, if so programmed, the solenoid S will close for a preset time blocking the return oil flow for a delay, holding the door open for a safe pedestrian pass-through period before closing.

The return movement of the wheel 26 in clockwise direction immediately causes the ring, with its arm 38 to move in a clockwise direction away from the sensor 20. Because the arm 38 is away from the sensor 20, the subsequent return of the arm 58 to the close proximity of the sensor 22 and the closing of that switch, in effect, will not reactivate the pump P.

It is understood that in the event that the user decides to open the door manually beyond the normal limit of travel at which the pump is deactivated, he can do so and the effect will be that the pinion shaft 16 will continue to rotate (FIGS. 10, 13) with no effect on the follower 56. When the door is finally released, the counter-clockwise turning (FIG. 9) will once again cause the cam lobes 52 to engage either side of the point 70 and return the follower to the position to which the deactivating arm 58 overlies the pump-off sensor 22 and the cycle is ready to be reactivated by "bumping" the door.

The distance which the door must be "bumped" out of its frame in order to activate the pump is preset by the position of the U-shaped bracket 92 which may be clampingly adjusted on the body by bolt 84 which engages when the door is closed.

If it is desired to cut to a minimum of say 3° the "bump" distance, the bracket 92 is fixed with leg 99 closer to the sensor 20. If, on the other hand, it is desired to increase the "bump" distance so that the door need be opened a minimum of say 10° before the assist unit is activated, the bracket 92 may be fixed with leg 99 farther from the sensor 20.

In either of the above cases, the power-assist will only be activated when the door is open far enough to bring the arm 38 over the sensor 20. In either case, the stop leg 100 halts the swinging of the arm 38 when the arm 38 overlies the sensor 20. From then on the ring 36 slips with respect to the wheel 26 and dial.

The setting of the point at which the power-assist cuts off is remarkably easy. All that is necessary after the door is installed is to turn the dial 42 clockwise (FIG. 2) bringing the notch 32 away from the follower 56 to a first arbitrarily selected position. The door is then "bumped" to see how far it opens under power-assist. If it does not open far enough, the dial 42 is turned farther clockwise to a second arbitrarily selected position. If it opens too far, the dial is turned back counter-clockwise to a second arbitrarily selected position, etc. By such trial and error, the desired open setting is arrived at. It will be understood that the turning of the dial 42 with the wheel 26 with respect to the shaft 16 is readily possible because of the friction fit between the wheel 26 and the outside of the collar 24. Of course the dial 42 fits loosely on the collar 24 and is free to turn thereon.

Once the "bump" distance is set in the manner described above with respect to the position of the bracket 92 and the "open" position is set with respect to the position of the wheel 26 vis-a-vis the follower 56, the unit is all set for repeated reliable operation.

Figure 7:
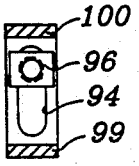
FIG. 7 is a sectional view taken on the line 7—7 of FIG. 6.
Figure 7A:
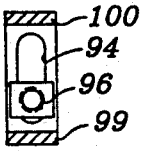
FIG. 7*a* is similar to FIG. 7 but showing the U-shaped stop member in a different setting.

It will be noted throughout that provisions are made for the adaption of the control unit for a door of different hand. Specifically, were the door in the example to have its hinged side on the left-hand side rather than the right-hand side as viewed in FIG. 1, the pinion shaft 16 and the wheel 26 and dial 38 would turn clockwise during the opening. To accommodate this, the position of the U-shaped stop 92 is shifted from the FIG. 7 position to the FIG. 7*a* position so that the arm 38, as the door opens, will move from where it engages the leg 100 to a position whereat the arm engages the leg 99 and overlies the sensor 20. Continuing the opening with the wheel moving in clockwise direction from above, as described, the lobes 52 on the wheel will engage wing 64 and notch 32 will receive the point 68 on the follower turning the deactivating arm of the follower 56 away from the sensor 22 in the opposite direction from that shown in FIG. 8. This cuts off the pump.

The advance represented by the invention is not only a more easily setable control for a power-assist operation, but also a more durable one in that no mechanical switches are involved, the number of cycles expectable from sensors such as 20, 22 is far greater than the number of cycles of a mechanical switch. The merit of the present invention, even over the meritorious arrangement shown in the above-described U.S. Pat. No. 4,995,194, will be clear.

Variations in the invention are possible without departing from the spirit of the invention. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A control for an hydraulically driven door closer/opener including an hydraulic circuit having an electric pump, an electric circuit for activating the pump, an hydraulic cylinder in the hydraulic circuit operatively enclosing a piston provided with a rack, the rack driving a pinion having a shaft extending outside the cylinder connected to the operating arm of the door, the pump adapted to pressurize the hydraulic circuit to drive the piston toward the open position of the door, the control comprising:

1) drive wheel frictionally mounted on the pinion shaft external of the cylinder, 2) pump-activating means comprising:

a. an activating arm extending outward from the wheel and frictionally gripped by the wheel, b. a fixed pump-on photoelectric sensor in the electric circuit mounted adjacent the end of the arm and adapted to turn on the pump when the arm arrives at a position closely proximate the sensor, c. an adjustable abutment surface to limit the movement of the arm away from the sensor, 3) pump-deactivating means comprising:

a. a driven rotary follower mounted on the closer/opener adjacent the wheel and having an axis parallel to the pinion shaft, b. a deactivating arm extending outward from the follower, c. a fixed pump-off photoelectric sensor in the electric circuit mounted adjacent the end of the deactivating arm and adapted to turn off the pump when the deactivating arm leaves a position closely proximate the pump-off sensor, d. interfitting lost-motion-transmitting means on the peripheries of the wheel and the follower, such that when the wheel nears a position corresponding to the desired openness of the door, the lost-motion-transmitting means causes the follower to rotate to swing the deactivating arm away from the sensor to turn off the pump.

2. A control as claimed in claim 1 wherein the sensors are mounted on a circuit board secured to the outside of the cylinder.

3. A control as claimed in claim 1 wherein the shaft freely carries a manually operated setting dial superposing the wheel and keyed for rotation therewith.

4. A control as claimed in claim 1 wherein the adjustable abutment surface is a U-shaped bracket having parallel stop legs on the respective sides of the distal end of the activating arm to operate with doors of either hand.

5. A control as claimed in claim 1 wherein the lost-motion-transmitting means is a Geneva mechanism comprising a recess in the periphery of the wheel and a projection on the periphery of the follower meshing momentarily into the recess so that the door can be manually opened beyond the normal desired openness of the door after the recess and projection unmesh as the wheel continues to turn.

6. A control as claimed in claim 1 wherein the electric and hydraulic circuit includes a solenoid valve and means for closing it when the pump is activated and thereafter for a preset delay period.

7. A control for an hydraulically driven door closer-/opener including an hydraulic circuit having an electric pump, an electric circuit for activating the pump, an hydraulic cylinder in the hydraulic circuit operatively enclosing a piston provided with a rack, the rack driving a pinion having a shaft extending outside the cylinder connected to the operating arm of the door, the pump adapted to pressurize the hydraulic circuit to drive the piston toward the open position of the door, the control comprising:

1) drive wheel frictionally mounted on the pinion shaft external of the cylinder, 2) pump-activating means comprising:

a. an activating arm extending outward from the wheel and frictionally gripped by the wheel, b. a fixed pump-on photoelectric sensor in the electric circuit mounted adjacent the end of the arm and adapted to turn on the pump when the arm arrives at a position closely proximate the sensor, c. abutment surfaces to respectively limit the movement of the activating arm away from the sensor, and to hold the arm closely proximate the sensor, said abutment surfaces being embodies in a U-shaped element defined by a pair of legs and a connecting bight, the legs serving as the respective abutment surfaces, and d. mounting means for mounting the U-shaped element by its bight so that the position of the abutment surfaces relative to the sensor can be adjustably fixed.

8. A control for an hydraulically driven door closer-/opener including an hydraulic circuit having an electric pump, an electric circuit for activating the pump, an hydraulic cylinder in the hydraulic circuit operatively enclosing a piston provided with a rack, the rack driving a pinion having a shaft extending outside the cylinder connected to the operating arm of the door, the pump adapted to pressurize the hydraulic circuit to drive the piston toward the open position of the door, the control comprising:

1) drive wheel frictionally mounted on the pinion shaft external of the cylinder, 2) pump deactivating means comprising:

a. a driven rotary follower mounted on the closer-/opener adjacent the wheel and having an axis parallel to the pinion shaft, b. a deactivating arm extending outward from the follower, c. a fixed pump-off photoelectric sensor in the electric circuit mounted adjacent the end of the deactivating arm and adapted to turn off the pump when the deactivating arm leaves a position closely proximate the pump-off sensor, d. interfitting lost-motion-transmitting means on the peripheries of the wheel and the follower, such that when the wheel nears a position corresponding to the desired openness of the door, the lost-motion-transmitting means causes the follower to rotate to swing the deactivating arm away from the sensor to turn off the pump.

9. A control as claimed in claim 8 wherein the lost-motion-transmitting means is a Geneva mechanism comprising a recess in the periphery of the wheel and a projection on the periphery of the follower meshing momentarily into the recess so that the door can be manually opened beyond the normal desired openness of the door after the recess and projection unmesh as the wheel continues to turn.

* * * * *